United States Patent [19]

Hyne et al.

[11] Patent Number: 4,487,264

[45] Date of Patent: Dec. 11, 1984

[54] USE OF HYDROGEN-FREE CARBON MONOXIDE WITH STEAM IN RECOVERY OF HEAVY OIL AT LOW TEMPERATURES

[75] Inventors: James B. Hyne, Calgary; J. David Tyrer, Oakville, both of Canada

[73] Assignee: Alberta Oil Sands Technology and Research Authority, Edmonton, Canada

[21] Appl. No.: 394,685

[22] Filed: Jul. 2, 1982

[51] Int. Cl.[3] ..... E21B 43/24

[52] U.S. Cl. ..... 166/300; 166/272; 166/303

[58] Field of Search ..... 166/270, 272, 300, 303

[56] References Cited

U.S. PATENT DOCUMENTS

| | | | |
|---|---|---|---|
| 2,734,578 | 2/1956 | Walter | 166/272 |
| 3,150,716 | 9/1964 | Strelzoff et al. | 166/272 |
| 3,333,637 | 8/1967 | Prats | 166/303 X |
| 3,457,996 | 7/1969 | Parker | 166/303 X |
| 3,506,309 | 4/1970 | von Hippel | 166/272 X |
| 3,770,398 | 11/1973 | Abraham et al. | 166/270 X |
| 3,980,137 | 9/1976 | Gray | 166/272 X |
| 4,119,566 | 10/1978 | Crouch et al. | 166/303 X |
| 4,156,462 | 5/1979 | Allen et al. | 166/272 X |

*Primary Examiner*—George A. Suchfield

*Attorney, Agent, or Firm*—Ernest Peter Johnson

[57] ABSTRACT

A process for recovering oil from a subterranean heavy oil-containing reservoir is provided, wherein steam and carbon monoxide are injected into the reservoir at a temperature less than about 260° C. At these low temperatures, the steam and hydrogen-free carbon monoxide are found to react in the reservoir, by the water gas reaction, to form carbon dioxide and hydrogen. These products both have upgrading effects on the heavy oil, enhancing its quality and producibility. At the low temperatures of the process, gasification and polymerization of the heavy oil are minimized.

1 Claim, No Drawings

USE OF HYDROGEN-FREE CARBON MONOXIDE WITH STEAM IN RECOVERY OF HEAVY OIL AT LOW TEMPERATURES

BACKGROUND OF THE INVENTION

The present invention relates to an oil recovery process for a subterranean heavy oil-containing reservoir. More particularly, the invention relates to an improvement in an in situ oil recovery process wherein steam is injected to heat the reservoir and thus render the heavy oil more mobile for recovery.

Heavy oil-containing reservoirs are those which contain crude petroleum or bitumen of such high viscosity that it cannot be recovered by conventional petroleum recovery techniques. Exemplary of such formations are the Athabasca and Cold Lake oil sand deposits of Alberta, Canada, the Lloydminster heavy oil deposits present in Alberta, Canada, and the oil sand deposits in Venezuela.

An insitu process for the recovery of such heavy oil usually includes reducing the viscosity of the heavy oil to thereby make it more amenable to flow. This is often done by injecting steam into the formation. In some cases, a communication zone, that is a permeable pathway, is first established between at least two wells penetrating the heavy oil-containing stratum. A communication zone may exist as naturally occurring permeable strata or may be established by conventional methods of hydraulic fracturing and propping. The steam is then injected through one well at high temperature and pressure. The steam passes through the communication zone, transferring sufficient heat to the adjacent heavy oil to lower the viscosity of same and render it more mobile. A steam/steam condensate/heavy oil mixture is produced at the second well.

Alternatively, in accordance with the well established huff and puff technique, steam injection and oil production may both take place at a single well. Steam is injected through the well into the formation. The steam is injected at high temperature and pressure to create a steam zone or steam chest around the well bore. When the injection pressure reaches a pre-determined level, injection is stopped and a back flow of heated formation fluids and injected fluids flows into the well and is produced. The injection and production cycles are repeated.

In situ recovery methods using steam injection, whether by continuous steam drive or cyclic steam techniques, have the disadvantage of leaving behind substantial amounts of oil. To enhance these steam-flooding processes, steam additives, such as solvents and gases, are often used. The solvent is included to solubilize some of the heavy oil and thereby lower the oil viscosity. Gaseous additives, such as carbon dioxide, are believed to enhance oil recovery by coming out of solution during pressure drawdown to assist in the pressure drive during the production cycle, or by otherwise improving the flowability of the oil.

In U.S. Pat. No. 4,156,462 issued May 29, 1979, to J. C. Allen, a two-step process is described for recovering oil. More particularly, a subterranean reservoir is first heated by injecting steam at temperatures in the range of about 260° C. to 800° C. Steam injection is then terminated and a mixture of carbon monoxide and hydrogen is injected into the heated portion of the reservoir. The carbon monoxide is said to react with the steam to produce carbon dioxide and additional hydrogen in the reservoir. These gases should lower the oil viscosity in the reservoir making the oil more amenable to recovery by a subsequent fluid drive system.

The conversion of carbon monoxide and steam to carbon dioxide and hydrogen is termed the water gas reaction:

$$CO + H_2O \rightleftharpoons CO_2 + H_2.$$

It is generally believed that the water gas reaction takes place at high temperatures, in excess of 400° C. Unfortunately, if such high temperatures are used in an oil reservoir, significant gasification and polymerization of the oil takes place. This of course reduces the amount of liquid oil which can be recovered. Furthermore, in a heavy oil reservoir, extensive polymerization forms tars which plug the fluid communication path.

The inclusion of hydrogen with the carbon monoxide in the process of the above-mentioned patent, is believed to be disadvantageous. Since the water gas reaction is a reversible reaction, the inclusion of hydrogen in the injection stream, especially at the suggested high temperature and pressure conditions, should drive the reverse rather than the forward reaction. This would favour the reactant side ($CO+H_2O$) rather than the product side ($CO_2+H_2$) of the process.

SUMMARY OF THE INVENTION

The inventors have discovered that, whereas it was previously thought that the water gas reaction could proceed only at high temperatures, the water gas reaction does proceed, in the presence of heavy oil reservoir material, at temperatures less than about 260° C. Furthermore, gasification and polymeration of the heavy oil are not found to be substantial at temperatures less than about 260° C.

While not being bound by the same, it is believed that certain components of the mineral matter associated with the heavy oil-containing deposits have a catalytic effect on the water gas reaction, thus permitting the reaction to proceed at a considerable rate at these low temperatures.

The process is characterized by a reduction in oil viscosity, both from the possible upgrading effect of the hydrogen reacting with the reservoir oil and from the carbon dioxide being solubilized in the reservoir oil. The in situ formed carbon dioxide also has the beneficial effect of enhancing oil recovery since the gas can come out of solution during production to enhance the pressure drive.

The carbon monoxide used in this process can be generated by partially combusting a carbon source such as coal or coke. In particular, the coke derived from coking oil sand bitumen can be utilized. The gaseous sulphur contaminants, generated during partial combustion of such coke, are injected with the carbon monoxide and are thus not released to the atmosphere. The heat of combustion can be used to generate steam for injection with the carbon monoxide. This constitutes a valuable, non-polluting use of high sulphur oil sand cokes and similar fuel values.

Broadly stated, the invention involves an improvement in an oil recovery process wherein steam is injected into the heavy oil reservoir. The improvement comprises injecting into the reservoir an injection stream consisting of steam and carbon monoxide, substantially free of hydrogen, at a temperature less than about 260° C., to form, in situ, carbon dioxide and hydrogen.

DESCRIPTION OF THE PREFERRED EMBODIMENT

In accordance with the process of this invention, carbon monoxide, substantially free of hydrogen, is used as a steam additive in an oil recovery process for a subterranean heavy oil reservoir.

The inclusion of carbon monoxide with the steam results in the formation, by means of the water gas reaction, of carbon dioxide and hydrogen. Each of these components have beneficial effects on the oil recovery process. As is well known, carbon dioxide is soluble in oil, and can therefore lower oil viscosity. Carbon dioxide can also increase the pressure drive in the formation during a production cycle by coming out of solution. For this reason, it is often desirable to utilize a pressure drawdown cycle during oil production. This technique should enhance the amount of carbon dioxide that comes out of solution.

As is also known, the hydrogen has the ability to upgrade the heavy oil in the reservoir by hydrogenation and hydrocracking reactions. In some instances the hydrogen may also cause some hydrodesulphurization of the oil.

These upgrading effects of the carbon dioxide and hydrogen significantly enhance the quality and producibility of the heavy oil.

The method of steam injection may be in accordance with any of the well known steam recovery processes, including steam drive, steam soak, and cyclic steam injection in a single or multi-well program.

In further accordance with this process, the steam and carbon monoxide injection stream is introduced to the reservoir at a temperature less than about 260° C. At reservoir temperatures substantially greater than 260° C., which correspond to injection pressures of about 680 psi or greater for saturated steam, a considerable amount of gasification and polymerization of the heavy oil is found to take place.

It should be understood that the upper temperature limit of 260° C. is meant to exclude only a long term exposure of the heavy oil in the reservoir to steam temperatures greater than about 260° C. The heavy oil should be able to withstand short term exposures to steam at higher temperatures. Since the steam injection stream cools rapidly during the short transit time in the wellbore and on contacting the reservoir, the temperature of the steam injection stream at the well surface can actually be higher than 260° C. Thus the phrase, "injecting at a temperature less than about 260° C.", is meant only to exclude long term exposure (more than several days) of the heavy oil in the reservoir to steam temperatures greater than about 260° C.

The particular steam temperature and pressure actually used in this process will depend on such specific reservoir characteristics as depth, temperature and oil viscosity and thus will be worked out for each reservoir.

Although not essential, it is preferable to inject the carbon monoxide simultaneously with the steam in order to achieve good mixing of the two components. Since the carbon monoxide is injected for reaction with the steam, it is most beneficial to have the two components together, at the desired low temperature, in the reservoir. In some instances it may be desirable to precede or follow a steam-carbon monoxide injection stream with a steam-only injection stream.

The quality of steam used in this process is not critical. There may be an economic advantage to using less than 100% quality steam since 100% quality steam, saturated or superheated, is more expensive and difficult to produce. However, the term 'steam', as used herein, is meant to include superheated steam, saturated steam and less than 100% quality steam.

The substantially hydrogen-free carbon monoxide gas stream may be produced by partially combusting a carbon source, for example coal or coke, in a known manner. There are presently large volumes of high sulphur-containing coke stockpiled at oil sand mining installations in Alberta, Canada. The major impediment to the commercial use of these oil sand coke by-products is the high sulphur content. In accordance with this process, these high sulphur-containing cokes can be partially combusted as a source of carbon monoxide. The sulphur content of the coke should appear for the most part, as a carbon oxysulphide contaminant in the produced carbon monoxide. Some sulphur dioxide might be formed, but under the partial oxidation conditions needed to form carbon monoxide, the sulphur dioxide should be a very minor product.

It is anticipated that the original sulphur values from the coke, after travelling through and contacting the reservoir, would emerge as hydrogen sulphide at the recovery well. It is known that carbon oxysulphide hydrolyzes to carbon dioxide and hydrogen sulphide. Additional hydrogen sulphide would be formed in the reservoir from hydrodesulphurization of the heavy oil. The presence of hydrogen sulphide in the production stream from the in situ steam flooding of heavy oils is to be expected and can be removed by known methods. Increasing the concentration of hydrogen sulphide by injecting carbon monoxide with contaminant sulphur values produced from high sulphur-containing cokes would not be a serious problem.

The amount of carbon monoxide injected, simultaneously or sequentially, with the steam is not critical. The optimum amount of carbon monoxide will vary with such factors as the type of heavy oil deposit being treated and the economics of gas generation and injection.

Experimental

The following experimental work is included to demonstrate the operability and preferred conditions of the process of the present invention. Oil sand samples, from both Canadian and Venezuelan oil sand deposits, were contacted with steam and carbon monoxide or steam alone under the following conditions:

Samples (typically 150 g) of whole oil sand core material were placed in an alloy steel pressure vessel capable of withstanding temperatures to 500° C. and pressures of up to 10,000 psi. The vessel volume was normally in the range of 260 to 290 ml. Distilled water was added to the vessel in an amount to obtain a ratio of between 0.2 and 0.6 oil sand bitumen to water. In those runs wherein CO was added to the system, the amount was usually about 0.30%, expressed in terms of mass charge of material in the vessel.

The loaded reaction vessel was heated in a thermostated high temperature air oven to the desired temperature. Temperature control to ±2° C. was possible over periods in excess of one month. At the end of each run the gas phase generated as a result of the chemical reactions occurring within the vessel was analyzed by gas phase chromatography. The condensed phase material (mineral plus hydrocarbon) was extracted to recover the oil using methylene chloride. Great care was exercised to ensure complete removal of the extracting solvent since very small residual quantities had a significant effect on the viscosity of the recovered heavy oil. A chemical drying agent was used to remove water and prevent loss of volatile components caused by thermal drying methods. The viscosity was measured at 90° C. using a thermostated Brookfield cone/plate type viscometer.

EXAMPLE I

This example is included to verify that the water gas reaction does take place when a sample of a heavy oil reservoir, in this case a whole oil sand sample, is contacted with carbon monoxide and steam at temperatures less than about 260° C. Table 1 compares the effect of a seven day thermal treatment of the water (steam) oil sand system with and without added CO.

TABLE 1

Stream Treatment of Oil Sand Core Sample With and Without Added CO: 7 days at 200° C.

| Conditions | Produced Gases ml/1,000 g heavy oil treated | | | | | Viscosity* Recovered Oil Centipoise |
|---|---|---|---|---|---|---|
| | $CO_2$ | $H_2$ | $H_2S$ | COS | $C_1$-$C_5$ | @ 90° C. |
| CO added | 1112 | 898 | 1.5 | 3.8 | 0.1 | 1124 |
| No CO added | 547 | 78 | 13 | — | 4.6 | 1520 |

*Viscosity of untreated recovered oil varies between 1350 and 1550 centipoise at 90° C. depending upon sample.

As is evident from the results, the presence of CO with steam, in contact with the oil sand bitumen in the whole core, resulted in the production of substantial additional amounts of $CO_2$ and $H_2$ even at 200° C. Furthermore the runs with CO and steam also showed a lowering in the viscosity of the oil, evidencing some upgrading effect on the oil. In the runs conducted without the CO, increased amounts of light hydrocarbon gases ($CH_4$ and $C_{2+}$) were produced, as compared with the runs conducted with CO. While not being bound by the same, it appears that the presence of CO with steam, at temperatures less than 260° C., actually suppresses the undesired gasification of the heavy oil.

The presence of CO also appears to suppress the formation of $H_2S$ although some of the sulphur values in the oil are removed as carbonyl suphide.

It will be noted that even in the absence of added CO, some $CO_2$ and $H_2$ was produced. This is believed to be due to the aquathermolysis reactions taking place between the steam and the oil sand. A substantial amount of the $CO_2$ produced is believed to result from decarboxylation reactions of the oil sand. The large difference between the $CO_2$ and hydrogen production in the absence of CO is clear evidence that the water-shift reaction is not significant since equimolar amounts of each gas would be produced if the water shift reaction were important. On the other hand, the gas phase data for reaction in the presence of CO shows a much more comparable production of hydrogen and carbon monoxide, as would be expected if the water shift reaction was operative. The fact that the hydrogen production appears to be less than equimolar could be due to additional $CO_2$ production from decarboxylation as observed in the absence of CO or the consumption of some of the produced hydrogen through upgrading reactions with the heavy oil.

EXAMPLE II

This example is a further illustration of the beneficial effects of added CO on the properties of the recovered oil and the continuing benefit with reaction time.

TABLE 2

Effect of Added CO and Reaction Time on Viscosity of Recovered Heavy Oil Sand

| Conditions | Reaction Temp. ° C. | Reaction Time-days | Viscosity of Recovered oil; centipoise @ 90° C. |
|---|---|---|---|
| unreacted | — | — | 1350–1550 |
| with added CO | 200 | 7 | 1124 |
| | 200 | 28 | 1061 |
| without added CO | 200 | 28 | 2000 |

In the presence of CO the viscosity reduction noted after seven days reaction at 200° C. continues as the reaction time lengthens. In the absence of CO an increase in measured viscosity was observed after 28 days reaction, compared with that for the untreated recovered heavy oil. Without being bound by the same it is believed that this observed increase may not be characteristic of all heavy oils since, in other samples, little change in viscosity in the absence of CO was observed. The evidence, however, does show that the beneficial effects of the added CO on the viscosity of the recovered oil continue over a substantial period of time. This is important since the reaction time in an actual reservoir situation would be substantial.

EXAMPLE III

This example demonstrates that the amount of oil recovered in the liquid phase, from an oil sand sample, decreases considerably as the steam temperature is raised substantially above 260° C.

TABLE 3

Effect of Reaction Temperature on Percentage of Oil Recovered

| Reaction Temp. ° C. | Reaction Days | Percent Recovery Liquid Oil Phase |
|---|---|---|
| 500 | 1 | 10 |
| 450 | 1 | 25 |
| 400 | 1 | 45 |
| 300 | 7 | 85 |
| 200 | 7 | 97+ |

The data in Table 3 shows the percent recovery of the liquid oil from the total available in the original sample as determined by initial extraction. The oil to water ratio used in all runs was 0.6. At steam temperatures substantially above 260° C., gasification and polymerization of the heavy oil was considerable, thereby limiting the amount of liquid oil to be recovered.

While the present invention has been disclosed in connection with the preferred embodiment thereof, the spirit and scope of the invention are as defined by the following claims.

The embodiments of the invention in which an exclusive property or privilege is claimed are defined as follows:

1. A process for enhancing the producability of heavy oil from a reservoir, comprising:

injecting into the reservoir steam and carbon monoxide, substantially free of hydrogen, at a temperature less than about 260° C., and reacting said injected steam and carbon monoxide in situ to form carbon dioxide and hydrogen, whereby the formed products enhance the producibility of the heavy oil.

* * * * *